US011466942B2

(12) United States Patent
Manenti

(10) Patent No.: US 11,466,942 B2
(45) Date of Patent: Oct. 11, 2022

(54) ANTI-EROSION DEVICE FOR A SHELL-AND-TUBE EQUIPMENT

(71) Applicant: ALFA LAVAL OLMI S.P.A, Suisio (IT)

(72) Inventor: Giovanni Manenti, Castelli Calepio (IT)

(73) Assignee: ALFA LAVAL OLMI S.P.A, Suisio (IT)

( * ) Notice: Subject to any disclaimer, the term of this patent is extended or adjusted under 35 U.S.C. 154(b) by 92 days.

(21) Appl. No.: 16/772,570

(22) PCT Filed: Dec. 12, 2018

(86) PCT No.: PCT/EP2018/084475
§ 371 (c)(1),
(2) Date: Jun. 12, 2020

(87) PCT Pub. No.: WO2019/115583
PCT Pub. Date: Jun. 20, 2019

(65) Prior Publication Data

US 2021/0003355 A1 Jan. 7, 2021

(30) Foreign Application Priority Data

Dec. 15, 2017 (EP) ..... 17425125

(51) Int. Cl.
*F28F 19/00* (2006.01)
*F28D 7/16* (2006.01)
*F28F 9/16* (2006.01)

(52) U.S. Cl.
CPC ..... *F28F 19/002* (2013.01); *F28D 7/16* (2013.01); *F28F 9/167* (2013.01)

(58) Field of Classification Search
CPC . F28F 19/002; F28F 9/167; F28D 7/16; F16L 58/00
See application file for complete search history.

(56) References Cited

U.S. PATENT DOCUMENTS 1,616,893 A * 2/1927 Finch ..... F28F 19/002 277/606
2,143,477 A * 1/1939 Dillon ..... F28F 19/002 138/39

(Continued)

FOREIGN PATENT DOCUMENTS

CN 2622659 Y 6/2004
CN 101228410 A 7/2008

(Continued)

OTHER PUBLICATIONS

English translation of the Korean Notice of Preliminary Rejection for Korean Application No. 10-2020-7020057, dated Oct. 6, 2021.

(Continued)

*Primary Examiner* — Paul Alvare
(74) *Attorney, Agent, or Firm* — Birch, Stewart, Kolasch & Birch, LLP

(57) ABSTRACT

Shell-and-tube equipment includes a tube bundle, an inlet tube-sheet, and an anti-erosion device including an outer tubular element and an inner tubular element. A first tubular end of the outer tubular element is connected the inlet tube-sheet, whereas a second free tubular end of the outer tubular element extends in an inlet channel. The inner tubular element is inserted into the outer tubular element, so as to substantially cover the entire internal surface of the outer tubular element, and into at least a portion of the corresponding tube to a point beyond the joint or the second side of the inlet tube-sheet whichever is further from the outer tubular element. The inner tubular element is joined to the outer tubular element by means of mechanical or hydraulic expansion of at least a first tubular portion of the inner tubular element against the internal surface of the outer tubular element.

20 Claims, 5 Drawing Sheets

(56) References Cited

U.S. PATENT DOCUMENTS

| | | | | | |
|---|---|---|---|---|---|
| 2,445,273 | A | | 7/1948 | Kennedy | |
| 3,707,186 | A | * | 12/1972 | Zorrilla | F28F 19/002 165/134.1 |
| 3,769,489 | A | * | 10/1973 | Charlesworth | F28F 9/18 219/60.2 |
| 4,103,738 | A | | 8/1978 | Aydelott et al. | |
| 4,176,612 | A | | 12/1979 | Speer | |
| 4,254,819 | A | * | 3/1981 | Worrell | F28F 19/002 165/134.1 |
| 4,401,153 | A | * | 8/1983 | Marsch | C01C 1/0452 165/134.1 |
| 4,585,057 | A | | 4/1986 | Marburger | |
| 4,607,689 | A | * | 8/1986 | Mochida | F22B 37/74 122/406.3 |
| 4,697,634 | A | * | 10/1987 | Foucher | F28F 9/0282 165/76 |
| 4,941,512 | A | * | 7/1990 | McParland | F16L 55/163 138/109 |
| 5,246,063 | A | * | 9/1993 | Fix | F28F 21/04 165/133 |
| 5,323,849 | A | * | 6/1994 | Korczynski, Jr. | F28D 7/16 165/158 |
| 5,474,122 | A | * | 12/1995 | Pierce | F28F 9/0229 165/134.1 |
| 5,775,269 | A | * | 7/1998 | Lawrence | F22B 37/08 122/511 |
| 5,979,545 | A | * | 11/1999 | Pierce | F28F 9/0229 165/134.1 |
| 6,960,333 | B2 | * | 11/2005 | Blanda, Jr. | F28F 21/087 423/376 |
| 7,252,138 | B2 | | 8/2007 | Burkhalter et al. | |
| 7,574,981 | B1 | * | 8/2009 | Schulz | F28D 7/16 122/235.12 |
| 8,210,245 | B2 | * | 7/2012 | Gillessen | F28F 9/167 165/134.1 |
| 10,006,719 | B2 | * | 6/2018 | Telgen | F28F 19/002 |
| 10,378,756 | B2 | * | 8/2019 | Collins, III | F22B 1/1838 |
| 2001/0040024 | A1 | | 11/2001 | Blanda, Jr. et al. | |
| 2006/0290137 | A1 | * | 12/2006 | Benettolo | F16L 41/082 285/204 |
| 2008/0202732 | A1 | | 8/2008 | Gillessen et al. | |

FOREIGN PATENT DOCUMENTS

| | | | |
|---|---|---|---|
| CN | 102967169 | A | 3/2013 |
| CN | 203479133 | U | 3/2014 |
| CN | 105518408 | A | 4/2016 |
| CN | 107062980 | A | 8/2017 |
| DE | 2201215 | A1 | 8/1972 |
| DE | 30 22 480 | A1 | 1/1982 |
| DE | 10 2005 032 118 | A1 | 1/2007 |
| FR | 2 508 156 | A1 | 12/1982 |
| GB | 200901 | | 7/1923 |
| GB | 2 266 951 | A | 11/1993 |
| JP | 7-167585 | A | 7/1995 |
| JP | 2001-56194 | A | 2/2001 |
| JP | 2012-37140 | A | 2/2012 |
| JP | 2012-215339 | A | 11/2012 |
| KR | 10-2011-0016263 | A | 2/2011 |
| NL | 7016348 | A | 5/1972 |
| RU | 1792157 | A1 | 1/1995 |
| SU | 909562 | A2 | 2/1982 |

OTHER PUBLICATIONS

Indian Office Action for Indian Application No. 202017029050, dated Mar. 30, 2021, with an English translation.

International Search Report, issued in PCT/EP2018/084475, dated Mar. 13, 2019.

Written Opinion of the International Searching Authority, issued in PCT/EP2018/084475, dated Mar. 13, 2019.

Translation of Russian Decision on Grant and Search Report for RU 2020123074 dated Dec. 14, 2020; pp. 1-8.

* cited by examiner

ANTI-EROSION DEVICE FOR A SHELL-AND-TUBE EQUIPMENT

BACKGROUND OF THE INVENTION

The present invention refers to an anti-erosion device for a shell-and-tube equipment and, more specifically, to an anti-erosion device for the tube-sheet of a shell-and-tube equipment.

Inlet tube-sheets of shell-and-tube equipment, like heat exchangers and chemical reactors, may be subjected to damages and early wear and tear when the tube-side fluid is characterized by high velocity and two-phases, as a fluid laden of solid particles or bubbles. Such a fluid can entail local erosion on inlet tube-sheet. Gases coming from steam cracking furnaces for ethylene production are an example of harmful fluid: cracked gas at high temperature and velocity, laden of coke particles, is often cooled by means of shell-and-tube heat exchangers (also called "transfer-line exchangers" or TLE) which inlet tube-sheet and tube-to-tube-sheet joints frequently suffer from significant wear and tear.

In order to eliminate or mitigate wear and tear of the inlet tube-sheet of a shell-and-tube equipment handling an erosive tube-side fluid, several solutions are available: among them, use of ferrules or sleeves represents a major solution. Ferrules or sleeves are short tubes or pipes, often provided with entry and exit ends of specific shape, that can be installed either outside or, partially or totally, inside inlet tube-sheet bores and tubes. Many types of ferrules or sleeves for facing erosion problems are known in the state of the art: few of them are here recalled.

For example, document FR 2508156 describes a tubular device that is an extension of the exchanging tube, fixed at the tube itself, which suffers from erosion in place of the exchanging tube.

Document U.S. Pat. No. 4,103,738 describes a perforated plate placed above the inlet tube-sheet and sleeves connected to the inlet tube-sheet. Sacrificial replaceable tubes, kept in place by both the perforated plate and the sleeves, are mounted so to abut with the exchanging tubes.

Document U.S. Pat. No. 4,585,057 describes a tube inlet guide with funnel shaped extensions which lower ends extend into the exchanging tubes. The tube inlet guide is kept in place by specific supports.

For the specific application on transfer-line exchangers (TLE), ferrules or sleeves design for facing erosion on tube-side inlet parts are as well known in the state of the art. For example, document U.S. Pat. No. 3,707,186 describes a ferrule which has the entry with a flared shape, which extends beyond the tube-sheet and which is partially embedded into a refractory lining installed on the tube-side face of the tube-sheet. The remaining portion of the ferrule is inserted into the respective exchanging tube. The exit of the ferrule has an internal diameter which is larger than the internal diameter of the central portion of the ferrule.

Document US 2008/202732 describes a tubular sleeve and a plate joined together, forming a sleeve with a plate. The tubular portion of the sleeve is inserted into the tube-sheet bore and into a respective exchanging tube, and it is expanded against the tube by rolling or hydraulic expansion. The end of the sleeve not inserted into the tube is provided with a plate, positioned at an angle of 90° with regard to the sleeve axis, covering the tube-side face of the tube-sheet.

From a general standpoint, many other design of ferrules or sleeves for protecting the inlet tube-sheet of a shell-and-tube equipment from other phenomena than erosion, like overheating and corrosion, have been disclosed. Some major examples are described in the following documents. Document US 2001/0040024 discloses a number of ferrules, or sleeves, of several shape and materials, to be installed on tube-side of inlet tube-sheets of shell-and-tube equipment operating under carburizing, nitriding or reducing environment, where the ferrules rest in a refractory layer.

Document DE 3022480 describes a device for protecting the tube-sheet of a heat exchanger for an ammonia converter effluent gas. The device is composed of two sleeves, one inserted into the other, where the outer sleeve is welded by one end to the tube-side face of the inlet tube-sheet and by the other end to a chamber wall of a bucket, and the inner sleeve, fixed to the outer sleeve, goes through the tube-sheet and through a first portion of the tubes.

Anchoring or holding ferrules or sleeves in place is generally a design issue. This is particularly critical when:

- the tube-side fluid flows at high velocity and is erosive, or
- the ferrules are installed in the outlet end of the exchanging tubes, or
- the shell-and-tube equipment is in vertical position and the tube-sheet equipped with ferrules is at the bottom.

In the first case, the ferrules or sleeves can vibrate or be subjected to a significant impinging action. In the second case, ferrules can be expelled from tubes, whereas, in the third case, ferrules may fall down. Ferrules or sleeves can be held in place by embedding the portion protruding outside the tube-side face of the tube-sheet into a refractory layer, as reported in documents U.S. Pat. No. 3,707,186 and US 2001/0040024 mentioned above. Ferrules or sleeves can also be fixed by rolling or hydraulically expanding the ferrule body against the exchanging tube, as reported in document US 2008/202732 mentioned above, or can be kept in place by means of a third element, like a supporting tube-sheet (as disclosed in document U.S. Pat. No. 4,103,738) or a sleeve (as disclosed in document DE 3022480).

The aforementioned documents, describing ferrules or sleeves for tube-sheet and tubes protection, include both advantages and disadvantages. For instance, a potential disadvantage for ferrules or sleeves simply abutted to exchanging tubes is given by misalignment or different tolerances about relevant internal diameters, which may represent an obstacle to tube-side flow and therefore a source of erosion and turbulence. Moreover, merely abutted devices can be used for upper tube-sheets only.

A potential disadvantage for ferrules or sleeves embedded into refractory is given by difficult maintenance in case of ferrules replacement. Moreover, the embedded ferrules and refractory system may suffer from thermal chocks.

Finally, ferrules or sleeves expanded against the exchanging tubes can engender damages on tubes during ferrules installation and removal for maintenance, and also during operations due to different thermal elongation between pressure parts and ferrules and local overheating.

SUMMARY OF THE INVENTION

One object of the present invention is therefore to provide an anti-erosion device for a shell-and-tube equipment which is capable of resolving the drawbacks of the prior art in a simple, inexpensive and particularly functional manner.

In detail, one object of the present invention is to provide an anti-erosion device for a shell-and-tube equipment that is capable of minimizing, or avoiding, the above-mentioned drawbacks without making difficult the inspection, removal and, in case, replacement of the device itself.

Another object of the present invention is to provide an anti-erosion device for a shell-and-tube equipment having a robust and simple innovative design.

These objects are achieved according to the present invention by providing an anti-erosion device for a shell-and-tube equipment as set forth in the attached claims.

In particular, these objects are achieved by a shell-and-tube equipment comprising a shell that surrounds a tube bundle. Said tube bundle comprises a plurality of tubes, wherein at least one end of each tube is provided with a joint to an inlet tube-sheet at respective tube-sheet bores for inletting a fluid in the shell-and-tube equipment. The inlet tube-sheet is provided with a first side, which receives the fluid from an inlet channel located upstream of said inlet tube-sheet, and with a second side, which is opposite to said first side and on which the tubes are joined. The inlet tube-sheet is connected to each tube of the tube bundle on said second side. Said shell-and-tube equipment comprises an anti-erosion device comprising a first outer tubular element and a second inner tubular element for at least a corresponding tube. Both the outer tubular element and the inner tubular element have a respective longitudinal axis that is parallel to the longitudinal axis of the corresponding tube. A first tubular end of said outer tubular element is connected to the first side of the inlet tube-sheet, whereas a second free tubular end of said outer tubular element extends in the inlet channel. Said inner tubular element is inserted into said outer tubular element, so as to substantially cover the entire internal surface of said outer tubular element, and into at least a portion of the corresponding tube to a point which is beyond said joint or the second side of the inlet tube-sheet whichever is farer from said outer tubular element. Said inner tubular element is joined to said outer tubular element by means of mechanical or hydraulic expansion of at least a first tubular portion of said inner tubular element against the internal surface of said outer tubular element. The inlet tube-sheet is connected to each tube of the tube bundle on said second side preferably such that each tube is either not inserted into the respective tube-sheet bore or partially inserted into the respective tube-sheet bore.

Further characteristics of the invention are underlined by the dependent claims, which are an integral part of the present description.

The anti-erosion device according to the present invention is designed for being installed in shell-and-tube equipment, like heat exchangers and chemical reactors, for protecting the inlet tube-sheet, the relevant tube-to-tube-sheet joints and the first portion of tubes from erosive action of the tube-side fluid. The anti-erosion device can also be of help in reducing the overheating in case the tube-side fluid is at high temperature. This anti-erosion device is characterized by robustness suitable to withstand severe operating conditions and simple design for easy maintenance.

The anti-erosion device according to the present invention is of interest for transfer-line exchangers (TLE). The process gas coming from a hydrocarbon steam cracking furnace is typically at 750-850° C., enters into the TLE inlet channel typically at 100-150 m/s and is laden of carbonaceous sub-products coming from cracking of hydrocarbons. Often such sub-products are constituted of hard particles which are potential source of erosion for the gas-side face of the inlet tube-sheet, for the inlet tube-to-tube-sheet joint and for the first portion of tubes. Yet, the anti-erosion device according to the present invention can also be used for other services than TLE, where a two-phase fluid at high velocity must be processed in a shell-and-tube equipment, as a slurry or gas from fluidized beds and combustors.

BRIEF DESCRIPTION OF THE DRAWINGS

The characteristics and advantages of an anti-erosion device for a shell-and-tube equipment according to the present invention will be clearer from the following exemplifying and non-limiting description, with reference to the enclosed schematic drawings, in which.

DETAILED DESCRIPTION OF THE PREFERRED EMBODIMENTS

Figure 1:
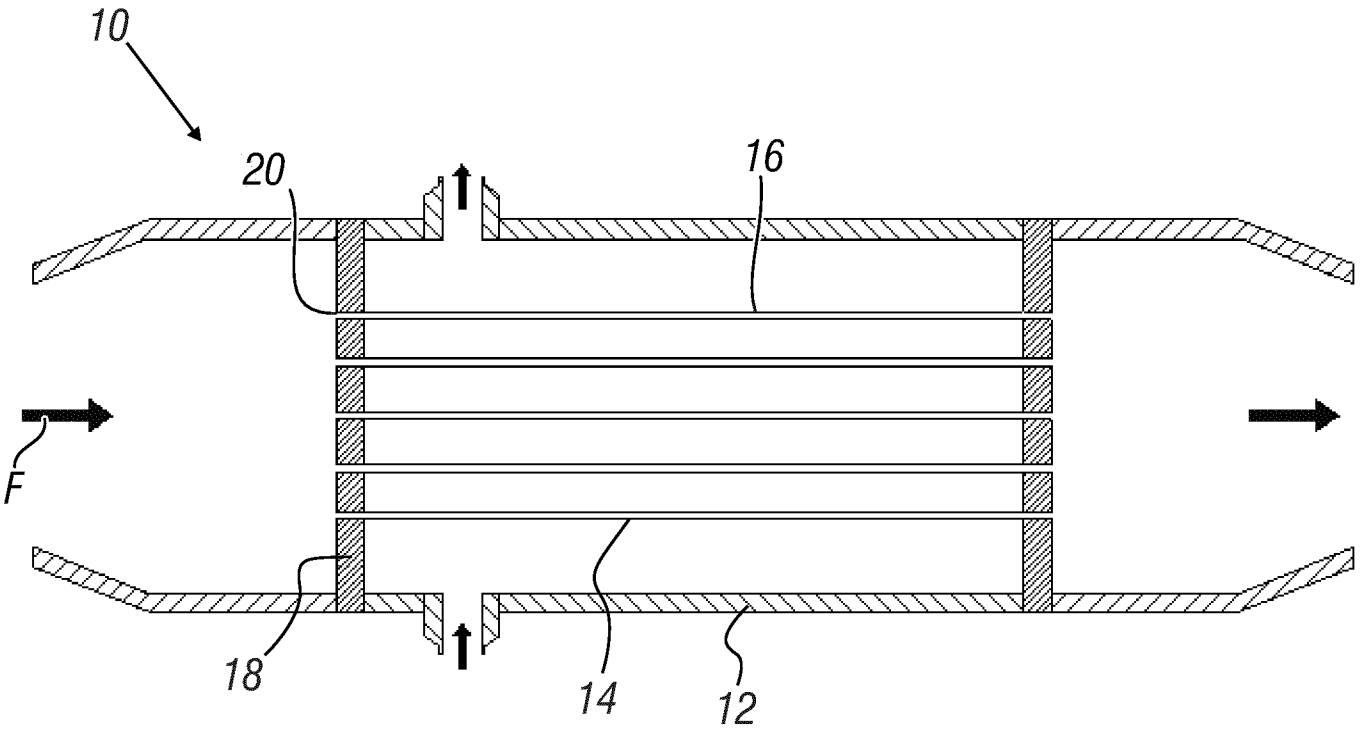
FIG. 1 is a schematic view of a shell-and-tube equipment with horizontally arranged tube bundle.

With reference to FIG. 1, a shell-and-tube equipment 10, more specifically a shell-and-tube heat exchanger 10, is shown. The shell-and-tube equipment 10 is of the type comprising a shell 12 that surrounds a tube bundle 14. Although the shell-and-tube equipment 10 is shown in a horizontal orientation, it may also be oriented vertically or at any angle with respect to a horizontal surface.

The tube bundle 14 comprises a plurality of tubes 16. The tubes 16 can be of any shape, like U-shaped or straight. At least one end of each tube 16 is joined to an inlet tube-sheet 18 provided with respective tube-sheet bores 20 for inletting a fluid F in the shell-and-tube equipment 10. Said at least one end of each tube 16 is provided with a joint 26 to the inlet tube-sheet 18 at the respective tube-sheet bores 20. The shell-and-tube equipment 10 further comprises an inlet channel connected to the inlet tube-sheet 18 on the opposite side of the shell 12 and in fluid communication with the tubes 16.

Figure 2A:
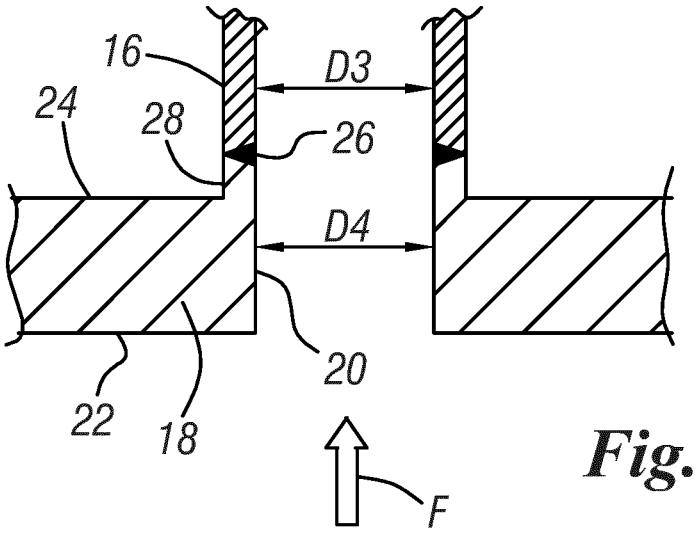
FIG. 2A is a partial sectional view of a first embodiment of a tube-to-tube-sheet joint in a shell-and-tube equipment according to the prior art.

With reference to FIG. 2A, a first embodiment of a tube-to-tube-sheet joint according to the prior art is shown. This tube-to-tube-sheet joint can be obtained, for example, in a shell-and-tube equipment 10 of the type shown in FIG. 1. The inlet tube-sheet 18 is provided with a tube-side face 22, facing the inlet channel. The tube-side face 22 of the inlet tube-sheet 18 thus receives the fluid F from the inlet channel, that is located upstream of said inlet tube-sheet 18. The inlet tube-sheet 18 is further provided with a shell-side face 24, jointed to each tube 16 by a weld 26 of butt-end type. This weld 26 is also called "inner bore weld" since it is generally made from the tube-sheet bore 20.

In this embodiment each tube 16 is not inserted into the respective tube-sheet bore 20 and usually has substantially the same internal diameter D3 of the diameter D4 of the tube-sheet bore 20. Each tube 16 is welded on the shell-side face 24 of the inlet tube-sheet 18. The inlet tube-sheet 18 may be preferably provided with a hub 28 on the shell-side face 24 and therefore the tube-to-tube-sheet joint 26 is a butt-end to butt-end weld.

Figure 2B:
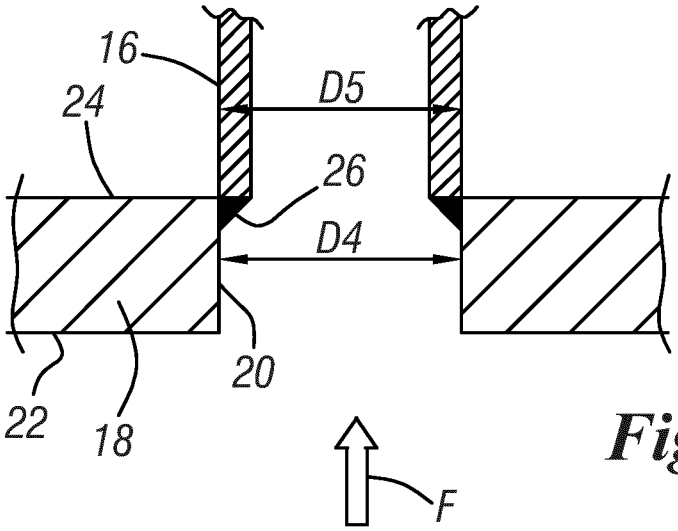
FIG. 2B is a partial sectional view of a second embodiment of a tube-to-tube-sheet joint in a shell-and-tube equipment according to the prior art.

FIG. 2B shows a second embodiment of a tube-to-tube-sheet joint according to the prior art. The joint is of fillet type, where the tube 16 is either not inserted into the tube-sheet bore 20, or partially inserted into the tube-sheet bore 20, i.e. inserted into the tube-sheet bore 20 for a partial length of the tube-sheet bore 20. The external diameter D5 of each tube 16 is substantially identical or smaller than the internal diameter D4 of the respective tube-sheet bore 20. The joint 26 is made either between the butt-end of the tube 16 and the surface of the tube-sheet bore 20, or between the external surface of the tube 16 and the surface of the tube-sheet bore 20. The joint 26 is made from the tube-sheet bore 20, and is located in proximity of the shell-side face 24 of the inlet tube-sheet 18.

Figure 3A:
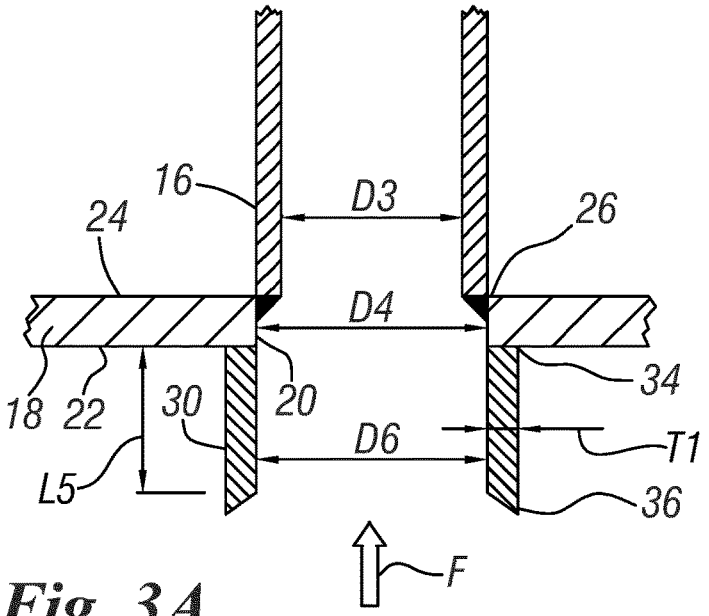
FIGS. 3A-3C are respective partial sectional views that show the main features of an anti-erosion device for a shell-and-tube equipment according to the present invention.
Figure 3B:
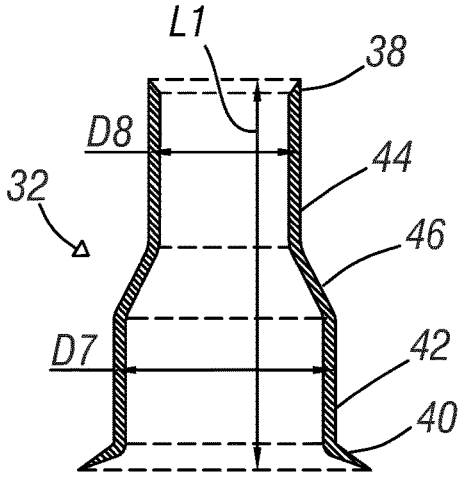
Figure 3C:
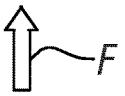
Figure 3C:
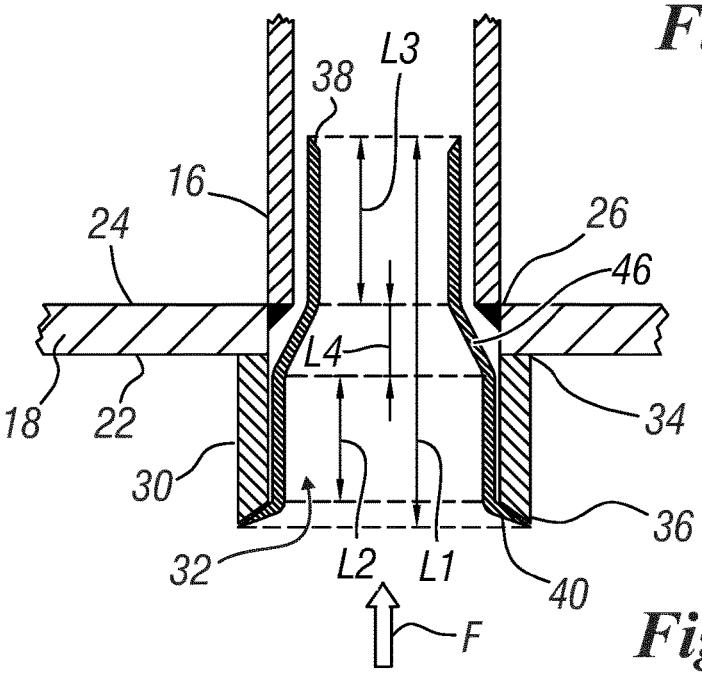

FIGS. 3A-3C show a generic embodiment of an anti-erosion device for a shell-and-tube equipment according to the present invention. By way of example, this anti-erosion device is applied to a tube-to-tube-sheet weld 26 as per FIG. 2B. However, it should be pointed out that the anti-erosion device according to the present invention can be adopted to different tube-to-tube-sheet joint types where the tube 16 is joined to the inlet tube-sheet 18 on the shell-side 24 of the tube-sheet 18. For example, the anti-erosion device according to the present invention can be installed in a shell-and-tube equipment 10 provided with any of the two joints represented in FIGS. 2A and 2B, or at any other tube-to-tube-sheet joint known in the state of the art where the tube is joined to the inlet tube-sheet on the shell-side of the tube-sheet. For the sake of simplicity, the following description refers to the tube-to-tube-sheet joint 26 of FIG. 2B, without limiting the conceptual application of the anti-erosion device according to the present invention to other tube-to-tube-sheet joints.

The tube-sheet 18 is provided with a tube-side face 22, which also is denoted first side 22. The first side 22 receives a fluid F from an inlet channel located upstream of the inlet tube-sheet 18. The tube-sheet 18 is also provided with a shell-side face 24, which also is denoted second side 24. The second side 24 of the inlet tube-sheet 18 is opposite to the first side 22, i.e. the second side 24 is the opposite side of the inlet tube-sheet 18 in relation to the first side 22 of the inlet tube sheet 18. The tubes 16 are joined to the inlet tube-sheet 18 on the second side 24. The inlet tube-sheet 18 is connected to each tube 16 of the tube bundle 14 on the second side 24. The tube 16 is either not inserted into the tube-sheet bore 20 or partially inserted into the tube-sheet bore 20. Thereby, the tube 16 does not extend through the tube-sheet bore 20. The inlet tube-sheet 18 is then connected to each tube 16 of the tube bundle 14 on said second side 24 such that each tube 16 is either not inserted into the respective tube-sheet bore 20 or partially inserted into the respective tube-sheet bore 20.

In some embodiments, the tubes 16 are not inserted into the tube-sheet bores 20. In other words, the tubes 16 do not extend into the tube-sheet bores 20. Thereby, the tubes 16 are located outside the tube-sheet bores 20. The inlet tube-sheet 18 is then connected to each tube 16 of the tube bundle 14 on said second side 24 such that each tube 16 is not inserted into the respective tube-sheet bore 20.

Figure 6:
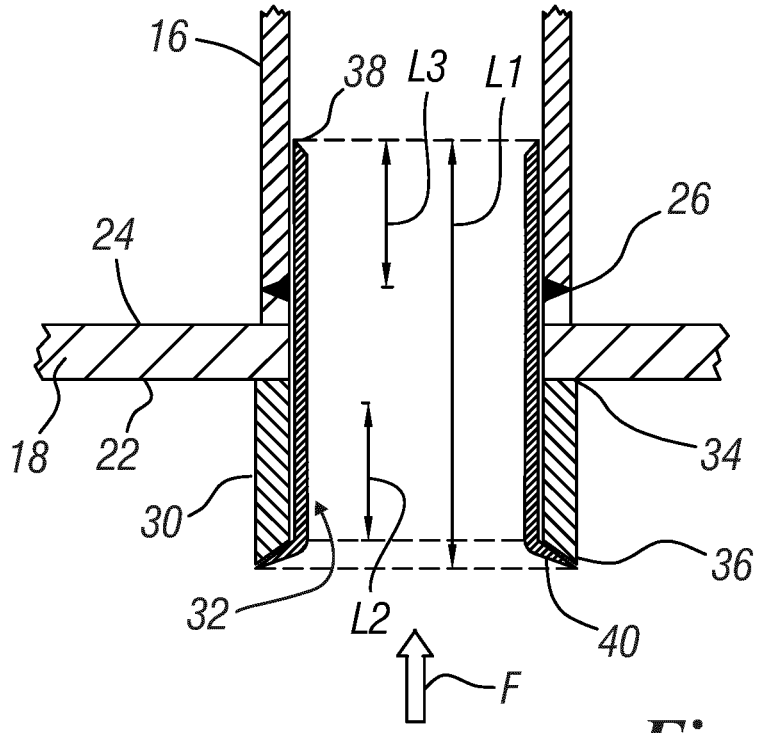
FIG. 6 is a partial sectional view of a further embodiment of the anti-erosion device for a shell-and-tube equipment according to the present invention.

The joint between the tube 16 and the inlet tube-sheet 18 in form of a weld 26 may be located outside the tube-sheet bore 20 as in FIGS. 2A and 6 or may be located inside the tube-sheet bore 20 as in FIGS. 2B, 3A, 3C, 4A, 4B and 5.

With reference to FIGS. 3A-3C, the anti-erosion device according to the present invention comprises two tubular elements or ferrules, i.e. a first ferrule 30, or the outer ferrule, and a second ferrule 32, or the inner ferrule. In particular, FIG. 3A shows only the outer ferrule 30, FIG. 3B shows only the inner ferrule 32 and FIG. 3C shows both the inner ferrule 32 and the outer ferrule 30. Both the outer ferrule 30 and the inner ferrule 32 have a respective longitudinal axis that is parallel to the longitudinal axis of a corresponding tube 16.

The outer ferrule 30 is connected by a first tubular end 34 to the tube-side face 22 of the inlet tube-sheet 18. The connection at said first tubular end 34 is preferably made by a weld, i.e. the outer ferrule 30 is preferably connected to the first side 22 of the inlet tube-sheet 18 by a weld. Yet, the outer ferrule 30 can also be integral with the inlet tube-sheet 18, that is the outer ferrule 30 is obtained by machining the inlet tube-sheet 18. For TLE application, the tube-side face 22 of the inlet tube-sheet 18 is preferably solidly layered by a special material which is erosion-proof. With such a design, the outer ferrule 30 results connected to such a layer by weld. Since the outer ferrule 30, also denoted outer tubular element 30, is connected to the tube-side face 22, i.e. the first side 22, of the inlet tube-sheet 18, the outer ferrule 30 (the outer tubular element 30) is located outside the tube-sheet bore 20. The outer ferrule 30 (the outer tubular element 30) is not inserted into the tube-sheet bore 20. In other words, the outer ferrule 30 (the outer tubular element 30) does not extend into the tube-sheet bore 20.

The second tubular end 36 of the outer ferrule 30 is free to extend in the inlet channel of the shell-and-tube equipment 10 and can have any shape. Preferably, this second free tubular end 36 is beveled or provided with a funnel shape, so as to minimize the impact of the tube-side fluid F and to convey the fluid F in a more regular way. The internal diameter D6 of the outer ferrule 30 can be either substantially identical or larger than the diameter D4 of the tube-sheet bore 20. In case of different tube-to-tube-sheet welds, the internal diameter D6 of the outer ferrule 30 could be either substantially identical or larger than the external diameter D5 of the tube 16.

The outer ferrule 30 is robust, with a thickness T1 which can be substantially identical to the thickness of the tube 16. Any material of construction can be used for the outer ferrule 30, such as any metallic material. In a preferred design, such material shall be carbon steel, low alloy steel or nickel-alloy. In other words, the outer tubular element (30) may be manufactured with a material chosen in the group consisting of carbon steel, low alloy steel and nickel alloy. The outer ferrule 30 can have an axial length L5, excluding the second free tubular end 36, ranging from 50 mm to 200 mm approx.

The inner ferrule 32 has an overall axial length L1, including the respective tubular ends 38 and 40, so that the inner ferrule 32 extends, at a first side corresponding to a first tubular end 38 thereof, into the tube 16 to a point which is beyond at least the tube-to-tube-sheet joint 26. Preferably, the inner ferrule 32 extends into the tube 16 to a point which is beyond either the tube-to-tube-sheet joint 26 or the shell-side face 24 of the inlet tube-sheet 18, depending on which of the joint 26 and the shell-side face 24 is farer from the outer ferrule 30. Thus, preferably the inner ferrule 32 extends into the tube 16 to a point which is beyond both the tube-to-tube-sheet joint 26 and the shell-side face 24 of the inlet tube-sheet 18. At the opposite side, corresponding to a second tubular end 40 thereof, the inner ferrule 32 extends either until to the second free tubular end 36 or beyond said second free tubular end 36 of the outer ferrule 30.

The inner ferrule 32 is characterized by two external diameters. A first external diameter D7 refers to a first tubular portion 42 of the inner ferrule 32 that is inserted for total or most length into the outer ferrule 30, whereas a second external diameter D8 refers to a second tubular portion 44 of the inner ferrule 32 that is inserted for total or most length into the tube 16. The first external diameter D7 and the second external diameter D8 can be substantially identical or different, depending on the tube-to-tube-sheet joint 26 and on the final design of the inner ferrule 32. In case the first external diameter D7 and the second external diameter D8 are different, the second external diameter D8 is smaller than the first external diameter D7, and the first tubular portion 42 is connected to the second tubular portion 44 preferably by means of a conical or pseudo-conical transition portion 46 of the inner ferrule 32. The transition portion 46, if any, is designed to minimize turbulence and impingement of the fluid F. In case the first external diameter D7 and the second external diameter D8 are substantially identical, like for example in the embodiment of the anti-erosion device shown in FIG. 6, the transition portion 46 is not present and the first 42 and second 44 tubular portions are directly connected, forming a single straight tubular portion. The second external diameter D8 of the second tubular portion 44 of the inner ferrule 32 is smaller than or substantially equal to the internal diameter D3 of the tube 16. The second external diameter D8 of the second tubular portion 44 is preferably as close to said internal diameter D3 of the tube 16 as possible, depending on the mechanical tolerances.

The second tubular end 40 of the inner ferrule 32, placed closer to the second free tubular end 36 of the outer ferrule 30, can have any shape. Preferably, the second tubular end 40 of the inner ferrule 32 is beveled or have a funnel shape, so as to minimize turbulence and impingement of the fluid F. The first tubular end 38 of the inner ferrule 32, placed farer from the second free tubular end 36 of the outer ferrule 30, can have any shape too. Preferably, the first tubular end 38 of the inner ferrule 32 is beveled or have a funnel shape, so as to minimize turbulence of the fluid F. The inner ferrule 32 is made of a metallic material. The inner ferrule 32 is preferably made of erosion resistant material, such as a high-content nickel alloy. Alternatively, the inner ferrule 32 can be made of a common carbon steel or low alloy steel and consequently the inner ferrule 32 acts as a sacrificial element to be replaced along time. In other words, inner tubular element 32 may be manufactured with a material chosen in the group consisting of carbon steel, low alloy steel and high-content nickel alloy.

As shown in FIG. 3C, the inner ferrule 32 is inserted into the outer ferrule 30, so as to substantially cover the entire internal surface thereof, and into at least a portion of the tube 16. The inner ferrule 32 is joined to the outer ferrule 30 by means of mechanical or hydraulic expansion of its first tubular portion 42, or of a major slice of said first tubular portion 42, against the internal surface of the outer ferrule 30. Practically, the inner ferrule 32 is expanded against the outer ferrule 30 for a length L2 which is preferably shorter than the axial length L5 of the outer ferrule 30. The length L2 is also preferably shorter than the overall axial length of the first tubular portion 42.

According to a preferred design, the second tubular end 40 of the inner ferrule 32 follows the shape of the second free tubular end 36 of the outer ferrule 30 in order to cover the portion of the outer ferrule 30 where the fluid F can impinge. FIG. 3C shows a transition portion 46 of the inner ferrule 32. As any person skilled in the art can realize, such a transition portion 46 is necessary when the tube-sheet bore diameter D4 is larger than the internal diameter D3 of the tube 16. The length L4 of the transition portion 46 is determined by the designer according to the dimensions of the inlet tube-sheet 18 and the respective tubes 16. The length L4 of the transition portion 46 is also determined in order to reduce the induced turbulence. It is also to be noted that, even if the transition portion 46 is present, the second tubular portion 44 and the first tubular portion 42 can have a substantially identical internal diameter due to a larger thickness of the second tubular portion 44 with regard to the thickness of the first tubular portion 42. The length L3 of the second tubular portion 44 inserted for total or most length into the tube 16 is determined by the designer according to the risk of erosion inside the tube 16. The length L3 of the second tubular portion 44 is also determined in order to smooth the turbulence of the fluid F.

Figure 4A:
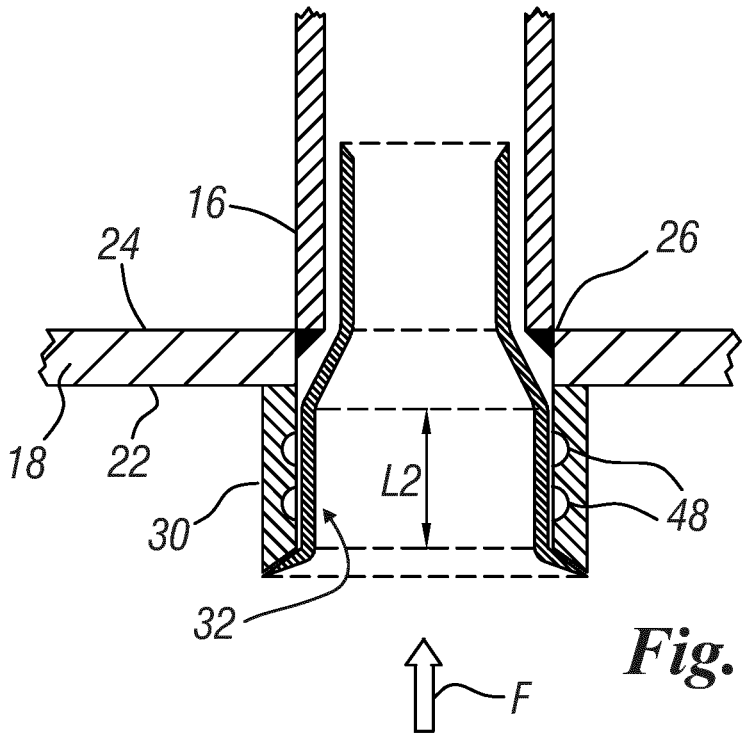
FIGS. 4A and 4B are respective partial sectional views of an embodiment of the anti-erosion device for a shell-and-tube equipment according to the present invention.

As shown in FIG. 4A, the outer ferrule 30 can be provided, on the internal surface thereof, with one or more grooves or hollows 48 designed to get a stronger fixing of the inner ferrule 32. According to such a design, the first tubular portion 42 of the inner ferrule 32 is expanded against the internal surface of the outer ferrule 30 for a length L2 and, at the grooves or hollows 48, the inner ferrule 32 is forced to penetrate into the grooves or hollows 48.

Figure 4B:
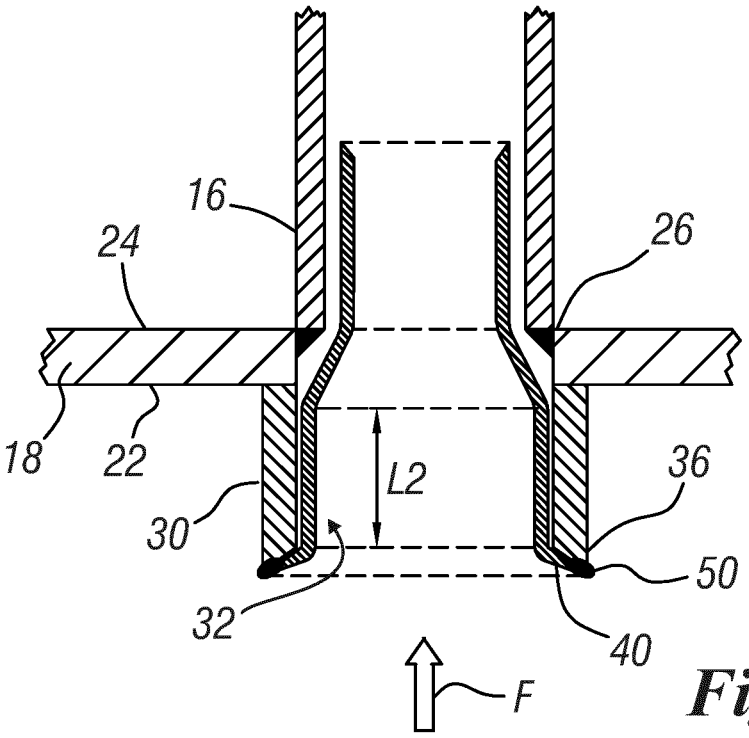
Figure 5:
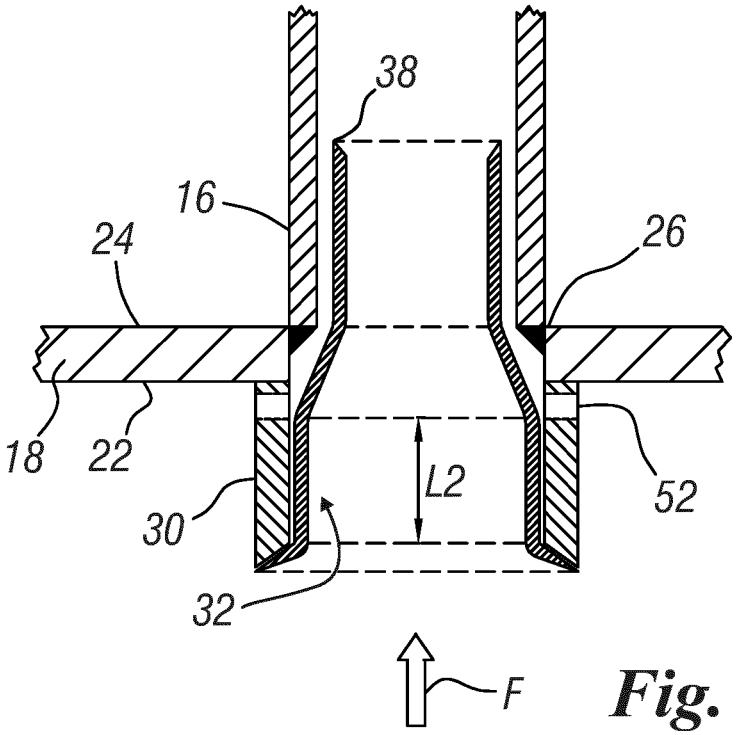
FIG. 5 is a partial sectional view of another embodiment of the anti-erosion device for a shell-and-tube equipment according to the present invention.

The inner ferrule 32, besides the expansion against the outer ferrule 30, can also be welded to the outer ferrule 30 by a welding 50 between the second free tubular end 36 of the outer ferrule 30 and the second tubular end 40 of the inner ferrule 32, as shown in FIG. 4B. Accordingly, the material of the welding 50 is erosion resistant.

According to another embodiment of the anti-erosion device, the inner ferrule 32, besides the expansion against the outer ferrule 30, can also be expanded against the tube 16. Practically, a slice of length L3 of the second tubular portion 44 inserted for total or most length into the tube 16 is mechanically or hydraulically expanded. In case of such a design, shown in FIG. 5, the outer ferrule 30 is preferably provided with slots or holes 52 made in a portion of the outer ferrule 30, where the inner ferrule 32 is not expanded against the outer ferrule 30 in order to vent the space between the inner ferrule 32 and the outer ferrule 30, the tube-sheet bore 20 and the tube 16. The outer ferrule 30 may be provided with the slots or holes 52 in a portion of the outer ferrule 30, in proximity of the tube-side face 22 of the inlet tube-sheet 18.

According to the above description, the erosive fluid F, to be processed by the shell-and-tube equipment 10, is conveyed by the anti-erosion device, comprising the outer ferrule 30 and the inner ferrule 32. The anti-erosion device collects the fluid F far from the inlet tube-sheet 18 and therefore reduces the impingement of the fluid F on the tube-side face 22 of the inlet tube-sheet 18. Moreover, in case the outer ferrule 30, or the inner ferrule 32, is provided with a funnel shaped second tubular end 40, the impingement of the fluid F on the inlet tube-sheet 18 can be further reduced or even eliminated. The outer ferrule 30 has also the important function, depending on the respective axial length L5, to reduce the turbulence of the flow before reaching the inlet tube-sheet 18 and the tubes 16.

The inner ferrule 32 protects the outer ferrule 30, the tube-sheet bore 20, the tube-to-tube-sheet joint 26 and the first portion of the tube 16 from direct impingement of fluid F and therefore from erosion. Since the fluid F is gently canalized and conveyed along the outer ferrule 30 and the inner ferrule 32 so to reduce turbulence, the erosive action of gas is also reduced. In case the fluid F is at high temperature, also the tube-side heat transfer coefficient is reduced and risk of local overheating is reduced as well.

The outer ferrule 30 can be considered to be a non-pressure part from construction codes standpoint. As a consequence, the outer ferrule 30 can be repaired or replaced without specific procedures. Such outer ferrule 30 is robust and can withstand high shear stresses or loads coming from the fluid F or from expansion of the inner ferrule 32. The inner ferrule 32 is not a pressure parts as well. Therefore, the inner ferrule 32 can be easily removed and, in case, replaced without affecting the inlet tube-sheet 18.

The space left in between the inner ferrule 32 and the tube-sheet bore 20 or the tube 16 is beneficial from a heat transfer standpoint, since it acts as a thermal barrier. Such a space may be filled in by a heat insulating material if necessary. Alternatively or additionally, also the external surface of the inner ferrule 32 may be coated with a heat insulating material if necessary.

It is thus seen that the anti-erosion device for a shell-and-tube equipment according to the present invention achieves the previously outlined objects.

The anti-erosion device for a shell-and-tube equipment of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The scope of protection of the invention is therefore defined by the enclosed claims.

The invention claimed is:

1. Shell-and-tube equipment comprising:

a shell that surrounds a tube bundle, said tube bundle comprising a plurality of tubes, at least one end of each tube being provided with a joint to an inlet tube-sheet at respective tube-sheet bores for inletting a fluid in the shell-and-tube equipment, the inlet tube-sheet being provided with a first side receiving the fluid from an inlet channel located upstream of said inlet tube-sheet, and with a second side, opposite to said first side, and on which the tubes are joined, the inlet tube-sheet being connected to each tube of the tube bundle on said second side such that each tube is either not inserted into the respective tube-sheet bore or is partially inserted into the respective tube-sheet bore; and an anti-erosion device comprising a first outer tubular element and a second inner tubular element for at least a corresponding tube, both the outer tubular element and the inner tubular element having a respective longitudinal axis that is parallel to the longitudinal axis of the corresponding tube, a first tubular end of said outer tubular element being connected to the first side of the inlet tube-sheet, a second free tubular end of said outer tubular element extending in the inlet channel, said inner tubular element being inserted into said outer tubular element, so as to substantially cover an entire internal surface of said outer tubular element, and into at least a portion of the corresponding tube to a point beyond said joint or the second side of the inlet tube-sheet whichever is farther from said outer tubular element, said inner tubular element being joined to said outer tubular element by means of mechanical or hydraulic expansion of at least a first tubular portion of said inner tubular element against the internal surface of said outer tubular element, wherein the first side of the inlet tube sheet is free from refractory material.

2. The shell-and-tube equipment according to claim 1, wherein the second free tubular end of said outer tubular element has a beveled or funnel shape.

3. The shell-and-tube equipment according to claim 1, wherein said inner tubular element has a first tubular end inserted into the corresponding tube, and a second tubular end extending either to the second free tubular end of said outer tubular element or beyond the second free tubular end of said outer tubular element.

4. The shell-and-tube equipment according to claim 3, wherein at least one of said first tubular end of said inner tubular element or said second tubular end of said inner tubular element has a beveled or funnel shape.

5. The shell-and-tube equipment according to claim 3, wherein said second tubular end of said inner tubular element follows the shape of said second free tubular end of said outer tubular element in order to cover the portion of said outer tubular element where the fluid can impinge.

6. The shell-and-tube equipment according to claim 3, wherein said inner tubular element is welded to said outer tubular element by a welding between said second free tubular end of said outer tubular element and said second tubular end of said inner tubular element.

7. The shell-and-tube equipment according to claim 3, wherein said inner tubular element has a first external diameter, corresponding to said first tubular portion that is inserted into said outer tubular element, and a second external diameter, corresponding to a second tubular portion of said inner tubular element that is inserted for a total or most length thereof into the corresponding tube.

8. The shell-and-tube equipment according to claim 7, wherein the second external diameter is smaller than the first external diameter and said first tubular portion is connected to said second tubular portion by means of a transition portion of said inner tubular element.

9. The shell-and-tube equipment according to claim 8, wherein said transition portion has a conical shape.

10. The shell-and-tube equipment according to claim 1, wherein an external tube diameter of each tube is substantially identical or smaller than an internal bore diameter of the respective tube-sheet bore.

11. The shell-and-tube equipment according to claim 7, wherein the first external diameter and the second external diameter are substantially identical and said first and second tubular portions are directly connected, forming a single straight tubular portion.

12. The shell-and-tube equipment according to claim 7, wherein said inner tubular element is joined to said tube by means of mechanical or hydraulic expansion of at least a part of said second tubular portion against the internal surface of said tube.

13. The shell-and-tube equipment according to claim 12, wherein said outer tubular element is provided with slots or holes made in a portion of said outer tubular element, where said inner tubular element is not expanded against said outer tubular element.

14. The shell-and-tube equipment according to claim 1, wherein said inner tubular element is expanded against said outer tubular element for a length shorter than the axial length of said outer tubular element.

15. The shell-and-tube equipment according to claim 1, wherein said outer tubular element is provided, on the internal surface thereof, with one or more grooves or hollows designed to get a fixing of said inner tubular element, wherein said inner tubular element is forced to penetrate into said grooves or hollows when said inner tubular element is expanded against said outer tubular element.

16. The shell-and-tube equipment according to claim 2, wherein said inner tubular element has a first tubular end inserted into the corresponding tube, and a second tubular end extending either to the second free tubular end of said outer tubular element or beyond the second free tubular end of said outer tubular element.

17. The shell-and-tube equipment according to claim 4, wherein said second tubular end of said inner tubular element follows the shape of said second free tubular end of said outer tubular element.

18. The shell-and-tube equipment according to claim 4, wherein said inner tubular element is welded to said outer tubular element by a welding between said second free tubular end of said outer tubular element and said second tubular end of said inner tubular element.

19. The shell-and-tube equipment according to claim 1, wherein the inlet tube-sheet is connected to each tube of the tube bundle on said second side such that each tube is not inserted into the respective tube-sheet bore.

20. Shell-and-tube equipment comprising:

a shell that surrounds a tube bundle, said tube bundle comprising a plurality of tubes, at least one end of each tube being provided with a joint to an inlet tube-sheet at respective tube-sheet bores for inletting a fluid in the shell-and-tube equipment, the inlet tube-sheet being provided with a first side receiving the fluid from an inlet channel located upstream of said inlet tube-sheet, and with a second side, opposite to said first side, and on which the tubes are joined, the inlet tube-sheet being connected to each tube of the tube bundle on said second side such that each tube is not inserted into the respective tube-sheet bore; and an anti-erosion device comprising a first outer tubular element and a second inner tubular element for at least a corresponding tube, both the outer tubular element and the inner tubular element having a respective longitudinal axis that is parallel to the longitudinal axis of the corresponding tube, a first tubular end of said outer tubular element being connected to the first side of the inlet tube-sheet, a second free tubular end of said outer tubular element extending in the inlet channel, said inner tubular element being inserted into said outer tubular element, so as to substantially cover an entire internal surface of said outer tubular element, and into at least a portion of the corresponding tube to a point beyond said joint or the second side of the inlet tube-sheet whichever is farther from said outer tubular element, said inner tubular element being joined to said outer tubular element by means of mechanical or hydraulic expansion of at least a first tubular portion of said inner tubular element against the internal surface of said outer tubular element.

* * * * *